United States Patent [19]

Gunneman

[11] Patent Number: 4,487,236

[45] Date of Patent: Dec. 11, 1984

[54] PNEUMATIC WEAVING MACHINE

[75] Inventor: Paul Gunneman, Mierlo, Netherlands

[73] Assignee: Ruti-Te Strake B.V., Deurne, Netherlands

[21] Appl. No.: 450,680

[22] Filed: Dec. 17, 1982

Related U.S. Application Data

[63] Continuation-in-part of Ser. No. 183,265, Sep. 2, 1980, abandoned.

[30] Foreign Application Priority Data

Sep. 21, 1979 [NL] Netherlands ..... 7907050

[51] Int. Cl.[3] ..... D03D 47/30

[52] U.S. Cl. ..... 139/435

[58] Field of Search ..... 139/435; 296/97

[56] References Cited

U.S. PATENT DOCUMENTS 4,190,067 2/1980 Kuda et al. ..... 139/435

FOREIGN PATENT DOCUMENTS 2031958 4/1980 United Kingdom ..... 139/435

*Primary Examiner*—Henry Jaudon

*Attorney, Agent, or Firm*—C. O. Marshall, Jr.

[57] ABSTRACT

A pneumatic weaving machine has an air transport channel for blowing the weft threads, formed by the reed lamellae and open at one side. A plurality of auxiliary blowing nozzles are directed through this open side obliquely inward. The invention provides means whereby the jet direction of the auxiliary nozzles may be influenced such that a larger or smaller component transverse to the weft direction is obtained. Thereby friction forces on the thread may be controlled dependent on the yarn type.

5 Claims, 6 Drawing Figures

PNEUMATIC WEAVING MACHINE

CROSS REFERENCE TO RELATED APPLICATION

This is a continuation-in-part of application Ser. No. 183,265, filed 9/2/80, now abandoned.

BACKGROUND OF THE INVENTION

The invention relates to a pneumatic weaving machine of the type in which the reed is composed of contoured lamellae which jointly delimit a guide channel for a transporting air flow, said channel being open at one side, namely the side facing the beating up line, said air flow being generated by a main blowing nozzle positioned at one end of the channel, and by a plurality of auxiliary blowing nozzles with their blowing apertures directed through the open side of the guide channel obliquely inward.

In pneumatic weaving machines of this type the angle between the axes of the transporting air jets delivered by the auxiliary blowing nozzles and the weft direction is chosen such that the transverse component of the force imparted by the transporting air jets to the thread to be transported is sufficient to keep the thread during the transport with certainty within the transport channel or, stated otherwise, is sufficiently large in order to prevent that the thread may leave the transport channel during the transport through the open side of that channel.

Experiments have shown that the angle of the transport jets issuing from the auxiliary blowing nozzles is not only important for the so called "transverse stability" of the thread in the transport channel but also influences other aspects of the thread behaviour during the transport phase.

It will be clear that an increase of the above indicated angle increases the chances of frictional contact of the thread with the "closed side" of the transport channel. Since this frictional contact is only disadvantageous for the average thread velocity which can be achieved, one has aimed at keeping said factor up till now as small as possible and therefore chosen the angle of the transport air jets not larger than was absolutely necessary in connection with the critical transverse stability.

SUMMARY OF THE INVENTION

Extensive experiments now have led to the recognition that the frictional contact between the weft thread and the closed side of the transporting channel (which is formed by the beating up sides of the reed lamellae) may be advantageous for certain yarn types and particularly for the smoother yarns. In the end phase of the weft movement the weft thread is suddenly braked to a stand-still. The weft thread then tends to stretch which is advantageous. However, the tendency of the weft thread to spring back afterwards into a less stretched condition is disadvantageous. This effect particularly occurs with smoother yarns. In this connection the frictional contact between the weft thread and the beating up sides of the reed lamellae appears to be in a position to issue a positive effect, particularly with smoother yarn types, since as a consequence thereof the springing back of the weft thread in the end phase of the weft movement may be effectively dampened. With fibrous yarns this frictional contact is less important since then the grip of the transporting jets of the auxiliary blowing nozzles provided at the end of the weaving shed, on the rougher surface of the weft thread, is sufficient to keep said thread in a stretched condition. Also for smoother yarn the grip, i.e. frictional contact, which prevents the stretched yarn from springing back must occur at the end of the weaving shed in order to keep the weft thread in a stretched condition throughout its length.

The invention aims at improving a pneumatic weaving machine of the above described type by using the above described recognition.

This aim is achieved according to the invention, in that in one or more positions along the open side of the guide channel, means are provided whereby the direction of the transporting air flow as discharged by the auxiliary blowing nozzles may be influenced in said positions to provide a larger or smaller component transverse to the weft direction.

Particularly said means are of such nature that the direction of the transporting air flow may be varied thereby during the weft movement.

In a first practical embodiment, in which auxiliary blowing nozzles constituted by hollow needles having lateral discharge apertures are used, said needles being directed with their axis transverse to the weft direction, one or more of said auxiliary blowing nozzles are mounted pivotable around their axis. In that case the pivotable movement may e.g. be controlled from the main shaft of a machine, through a control cam.

In a second practical embodiment a selectively controlled additional auxiliary blowing nozzle is provided between two auxiliary blowing nozzles oriented in a fixed position, the additional blowing nozzle having a discharge aperture which is directed substantially transverse to the weft direction. This embodiment is particularly suitable for application in processing smoother yarns.

A third practical embodiment is characterized in that adjacent to at least one of the auxiliary blowing nozzles a member is provided which is movable between an inoperative and an operative position, the member being in the operative position in the path of the issuing air jet of that auxiliary blowing nozzle and tending to deflect said jet in a direction transverse to the weft direction. Preferably the movement of this deflecting member is controlled such, e.g. through a control cam, that the member arrives in its operative position at least in the last phase of the weft movement. Thus the member arrives in its operative position as the weft thread is attaining its stretched, arrested state, so that the resulting frictional contact between the weft thread and the reed lamellae will prevent the stretched weft thread from springing back.

DESCRIPTION OF THE PREFERRED EMBODIMENTS

Figure 1A:
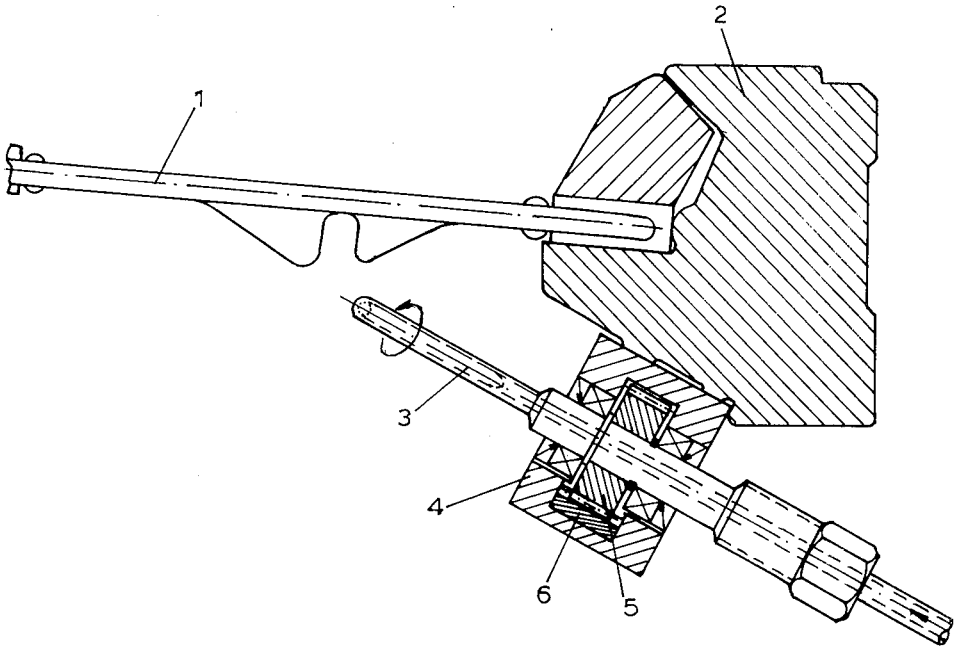
FIG. 1*a* and FIG. 1*b* show respectively a cross-section and a longitudinal section through the reed part of the pneumatic weaving machine according to the invention in a first embodiment.

In FIG. 1*a* the reed is indicated 1, the reed beam 2 and the auxiliary blowing nozzles indicated 3, which are distributed along the weaving width and mounted on the reed beam.

In the embodiment according to FIG. 1*a* the auxiliary blowing nozzles 3, which are in known manner in the form of hollow needles, having a lateral discharge aperture, are pivotably mounted in a housing 4. The needle-shaped blowing nozzles 3 carry a pinion 5 which is in engagement with a rack 6 which is guided through the housings 4 jointly.

Figure 1B:
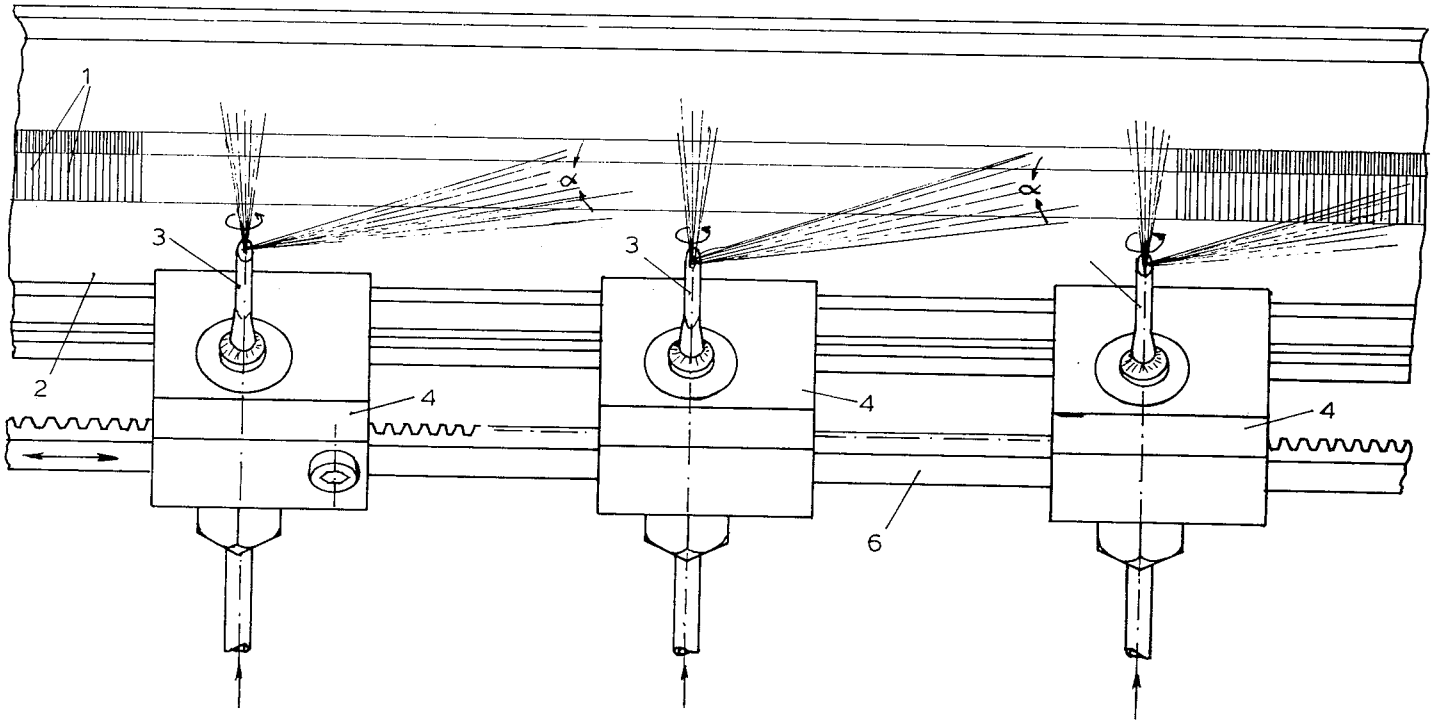

In FIG. 1*b* the blowing nozzles 3 have an angular position such that the axes of the issuing conical air jets form an angle $\alpha$ with the direction in which a weft thread is moved during the weft phase through the transporting channel constituted by the reed lamellae jointly.

By moving the rack 6 in the direction of the double arrow the blowing nozzles 3 are pivoted around the axis and the angle $\alpha$ will increase or decrease respectively and the issuing air jets will obtain a larger or smaller component respectively in the direction transverse to the path of movement of the weft thread. Thereby the frictional contact of the weft thread with the back side or "closed side" of the transporting channel is increased or decreased respectively, as is explained above.

It will be clear that the angle $\alpha$ need not have the same value for all the blowing nozzles, whereas it is also conceivable to mount only some of the blowing nozzles 3 pivotable around their axis.

Figure 2:
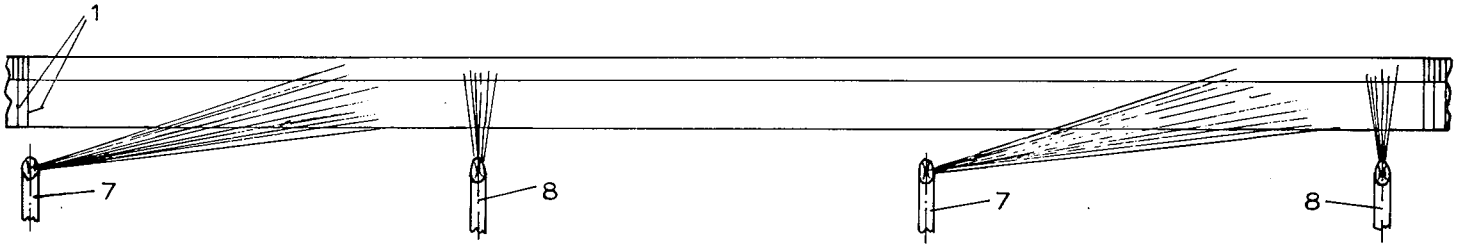
FIG. 2 shows a schematic horizontal longitudinal section through the reed part of the weaving machine according to the invention in a second embodiment.

In the embodiment according to FIG. 2 a plurality of needle-shaped blowing nozzles 7, having lateral discharge apertures, which are known per se, are mounted in a fixed position. The axes of the issuing air jets of said blowing nozzles thereby form a very small fixed angle with the axis of the transporting channel constituted by the reed lamellae. A plurality of additional blowing nozzles of substantially the same type as the blowing nozzles 7 are indicated 8, the issuing air jets thereof being directed at an angle of substantially 90° to the transport direction of the weft thread. In this embodiment the blowing nozzles 7 attend to the transport of the weft thread through the weaving shed, while the additional blowing nozzles 8 are only supplied with air, e.g. when processing smooth yarns, if one wishes to further the frictional contact between the weft thread and the back side of the transporting channel.

Figure 3:
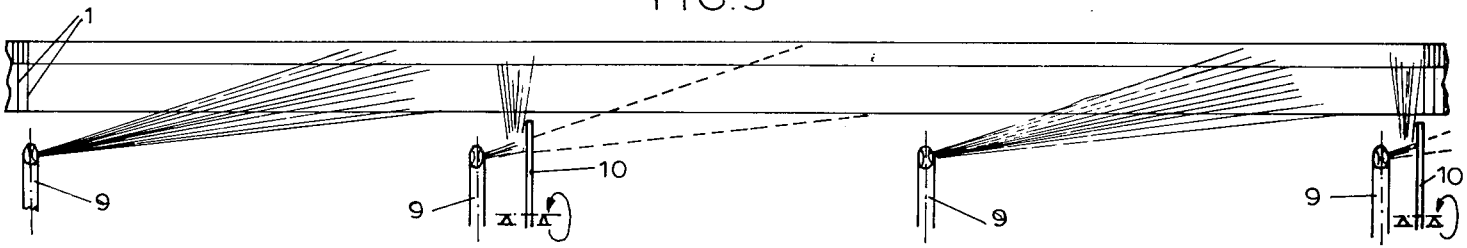
FIG. 3 shows a similar section as FIG. 2, through the reed part of the machine according to the invention, in a third embodiment.

Finally FIG. 3 shows an embodiment in which all blowing nozzles 9, again in the shape of hollow needles having lateral discharge apertures, have a fixed (angular) position.

Influencing the direction of the issuing air jets in at least some of said blowing nozzles is achieved in this embodiment by a flat member 10 which is pivotable or rotatable between an inoperative position and an operative position. In the inoperative position the member 10 is completely outside the conical air jet of the relative blowing nozzle, whereas in the operative position the member enters the path of the issuing air jet and tends to deflect said jet in a direction transverse to the path of movement of the weft thread.

Figure 4:
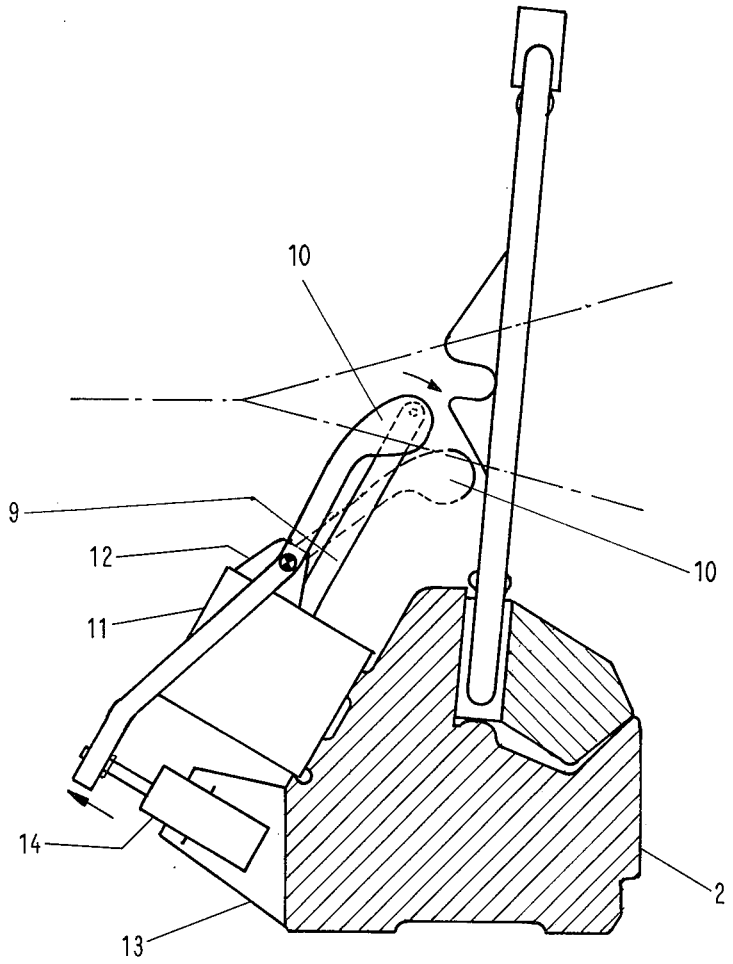
FIG. 4 shows a cross-section through the reed part of the machine according to said third embodiment.

As shown in FIG. 4, the auxiliary blowing nozzle 9, which is conventional in form, is fixed in a housing 11 mounted on the reed beam 2. The member 10 is pivoted in a bracket 12 mounted on the housing 11. Another bracket 13 mounted on the reed beam 2 carries an electromagnet 14 connected to the member 10. Energization of the electromagnet 14, which is timed in synchronism with the operation of the machine, moves the member 10 to the full-line position shown in FIG. 4 to deflect the jet issuing from the nozzle 9 as hereinbefore described.

Figure 5:
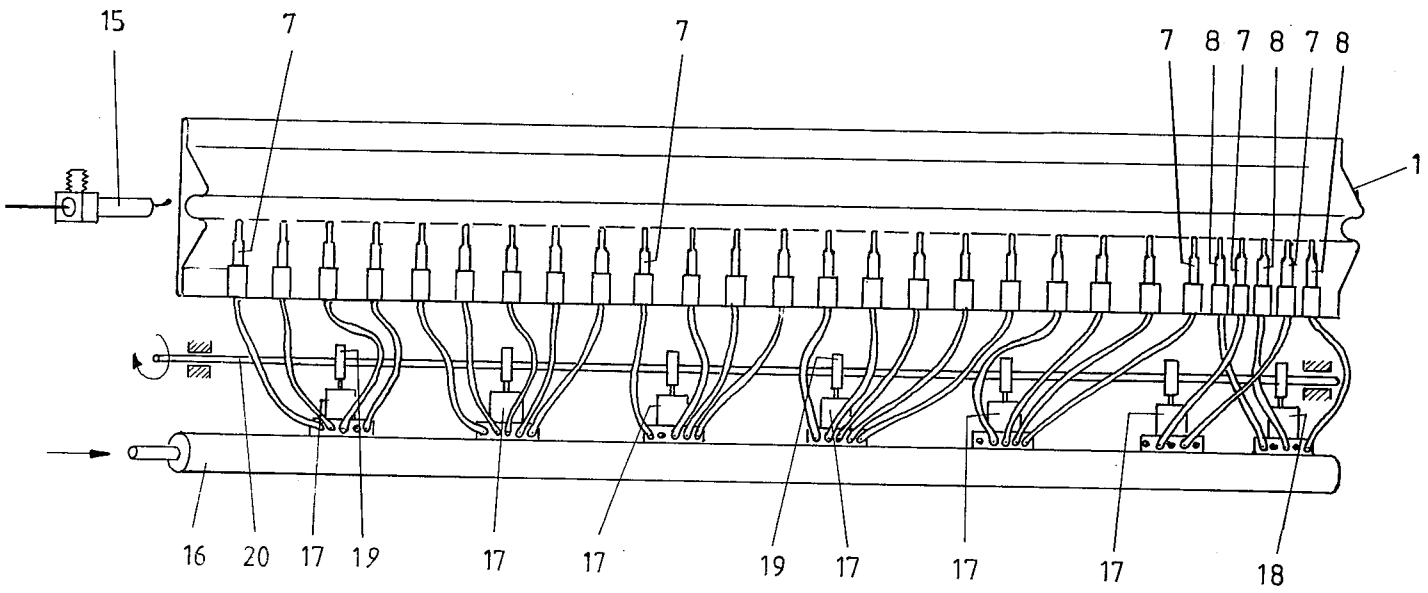
FIG. 5 is a perspective view showing the full length of a sley with three nozzles controlled according to the invention at the end of the sley.

FIG. 5 shows a reed 1, a main blowing nozzle 15, and a compressed air manifold 16. Air valves 17 mounted on the manifold 16 control the supply of compressed air to the auxiliary blowing nozzles 7. So far the structure in FIG. 5 is conventional.

The transversely directed nozzles 8 of FIGS. 2 and 5 are controlled by a separate air valve 18. All of the valves 17 and 18 are operated by cams 19 on a cam shaft 20 driven from the main shaft of the machine. The transversely directed nozzles 8 are energized as the weft thread attains its stretched state, at the moment hereinbefore described. Transversely directed nozzles 8, like the other nozzles which are controlled in accordance with the present invention, are located adjacent to the end of the shed as hereinbefore explained.

I claim:

1. A pneumatic weaving machine comprising a reed composed of contoured lamellae jointly delimiting a guide channel which is open on the side facing the beating-up line, a main blowing nozzle positioned to direct an air jet into one end of said channel, and a plurality of auxiliary blowing nozzles having blowing apertures directed into said channel through the open side thereof, characterized in that means are provided for varying the jet produced by at least one of said auxiliary blowing nozzles to vary the amount of the component of said jet that is transverse to said channel, said means being of such a nature that the direction of the jet may be varied thereby during the weft movement.

2. A weaving machine according to claim 1, in which the auxiliary blowing nozzles have the shape of hollow needles provided with lateral discharge apertures, the needles being directed with their axis transverse to the weft direction, characterized in that at least one of said auxiliary blowing nozzles is mounted pivotable around its axis.

3. A weaving machine according to claim 1, characterized in that a selectively controlled additional auxiliary blowing nozzle having a discharge aperture directed substantially transverse to the weft direction is mounted between two auxiliary blowing nozzles oriented in a fixed position.

4. A weaving machine according to claim 1, characterized in that at least adjacent to one of the auxiliary blowing nozzles a member is provided which is movable between an inoperative and an operative position, the member being in the operative position in the path of the issuing air jet of that auxiliary blowing nozzle and tending to deflect said jet in a direction trasverse to the weft direction.

5. A weaving machine according to claim 4, characterized in that the movement of the deflecting member is controlled such that the member enters its operative position at least in the last phase of the weft movement.

* * * * *